United States Patent [19]

Glantschnig

[11] Patent Number: 4,524,688

[45] Date of Patent: Jun. 25, 1985

[54] WIPER ASSEMBLY FOR FLAT-SCREEN PRINTER

[75] Inventor: Josef Glantschnig, Wölfnitz, Austria

[73] Assignee: Johannes Zimmer, Klagenfurt, Austria

[21] Appl. No.: 613,594

[22] Filed: May 23, 1984

[30] Foreign Application Priority Data

May 24, 1983 [AT] Austria ..... 1882/83

[51] Int. Cl.[3] ..... B41L 13/18; B41L 27/00

[52] U.S. Cl. ..... 101/123; 101/124

[58] Field of Search ..... 101/51, 114, 116, 119, 101/120, 121, 122, 123, 124, 126; 118/256, 261, 406 X

[56] References Cited

U.S. PATENT DOCUMENTS

| | | | |
|---|---|---|---|
| 3,915,088 | 10/1975 | Svantesson | 101/124 |
| 4,036,129 | 7/1977 | Zimmer | 101/120 |

FOREIGN PATENT DOCUMENTS

| | | | |
|---|---|---|---|
| 1270577 | 3/1964 | Austria | 101/123 |
| 0081476 | 11/1982 | European Pat. Off. | 101/120 |
| 3032401 | 8/1980 | Fed. Rep. of Germany | 101/120 |
| 1565279 | 4/1969 | France | 101/120 |

*Primary Examiner*—Clyde I. Coughenour
*Assistant Examiner*—William L. Klima
*Attorney, Agent, or Firm*—Karl F. Ross; Herbert Dubno

[57] ABSTRACT

An apparatus for printing a pattern of a flat horizontal screen on an underlying substrate comprises a wiper assembly mounted on a carriage above the screen and an electromagnet beneath the screen reciprocable along the latter jointly with the carriage. A cradle limitedly pivotable on the carriage about a horizontal axis extends across the screen and supports, via adjustable holders, a working wiper and a distributing wiper on opposite sides of its pivotal axis. The working wiper, which may be a blade or a roller, directly overlies the electromagnet and is magnetizable and/or accompanied by a magnetizable mass whereby energization of the electromagnet attracts the side of the cradle bearing that wiper to press it against the screen for forcing dyestuff therethrough onto the substrate, this side trailing during a printing stroke. When the electromagnet is de-energized at the end of that stroke and motion is reversed, with the screen and the carriage lifted off the substrate, the relatively heavy distributing wiper causes a tilt in the opposite direction and contacts the screen to spread the residual dyestuff thereover during the return stroke. When the working wiper is a magnetically permeable roller, a permanent magnet on its holder—weaker than the energized electromagnet—attracts that roller upward during de-energization.

8 Claims, 5 Drawing Figures

WIPER ASSEMBLY FOR FLAT-SCREEN PRINTER

FIELD OF THE INVENTION

My present invention relates to an apparatus for printing a pattern on a horizontal substrate by way of a flat screen and, more particularly, to a wiper assembly for such a screen printer.

BACKGROUND OF THE INVENTION

In flat-screen printers it is known to use a combination of two wipers, which may be respectively referred to as a working wiper and a distributing wiper, that lie above the printing screen and are jointly swivelable about a horizontal axis between two limiting positions in which one or the other wiper touches or bears upon the upper screen surface. Upon a relative displacement of the wiper assembly and the screen in one direction perpendicular to a vertical plane containing the pivotal axis, and with the working wiper pressed against the screen surface, dyestuff deposited on that surface is leveled by the raised distributing wiper and is then forced by the working wiper through the perforations of the screen onto the underlying substrate. On a subsequent return stroke, with the wiper assembly tilted into the opposite position and with the screen lifted off the substrate, the distributing wiper spreads the remaining dyestuff over the screen surface without printing.

In rotary-screen printers it is known to use a working wiper which, instead of having the usual form of a doctor blade, is designed as a magnetizable roller attracted by a magnet in an underlying printing table onto the screen during a printing stroke.

OBJECTS OF THE INVENTION

The general object of my present invention is to provide an improved flat-screen printer, of the type referred to, having simple means for controlling the swing of its swivelable wiper assembly about its pivotal axis.

A more particular object is to provide means in such an apparatus for selectively varying the contact pressure exerted upon the screen by the working wiper during a printing stroke.

SUMMARY OF THE INVENTION

An apparatus embodying my present invention, having a flat screen with a pattern of dyestuff-permeable perforations spanning a horizontal frame while overlying a substrate to be printed, comprises a carriage which is movable relatively to that frame along a horizontal path at a lower level in one direction (i.e. during a printing stroke) and at a higher level in the opposite direction (on a return stroke). The carriage is provided with support means swingable between an operating position and an alternate position about a horizontal pivotal axis transverse to the path of relative motion. An at least partly magnetizable first mass, carried by the support means on one side of the pivotal axis, includes a working wiper extending across the frame above the screen. A nonmagnetizable second mass heavier than the first mass, carried by the support means on an opposite side of the pivotal axis, includes a distributing wiper also extending across the frame above the screen. Disposed directly below the first mass, underneath the screen and the substrate, is at least one electromagnet which is movable concurrently and codirectionally with the carriage relatively to the screen frame and is energizable by associated switch means during the operating stroke to attract the working wiper onto the screen; during the return stroke, when the electromagnet is de-energized, gravity swings the support means into the alternate position thereof to lift the working wiper off the screen while the distributing wiper descends. The frame and the carriage are vertically movable between the aforementioned lower and higher levels to keep the screen clear of the substrate during the return stroke.

Pursuant to a more particular feature of my invention, a cradle serving as the support means for the two wipers is provided with adjustable holders for changing the separation of either wiper from the screen in an elevated position thereof. This makes it possible, in the case of a working wiper designed as a doctor blade, to maintain a small gap of adjustable width between the blade edge and the screen in the operating position of the cradle. Conversely, the distributing wiper may be kept out of contact with the screen in the alternate cradle position when such contact is not desired during the return stroke. Upon elimination of the aforementioned gap, the contact pressure of the working wiper—whether a blade or a roller—during the printing stroke can be adjusted by varying the energizing current of the electromagnet.

In the case of a magnetizable roller serving as the working wiper, a further feature of my invention resides in the provision of a permanent magnet above that roller which is weaker than the underlying electromagnet in its energized state and upon de-energization thereof lifts the roller off the screen.

BRIEF DESCRIPTION OF THE DRAWING

The above and other features of my invention will now be described in detail with reference to the accompanying drawing in which.

SPECIFIC DESCRIPTION

Figure 1:
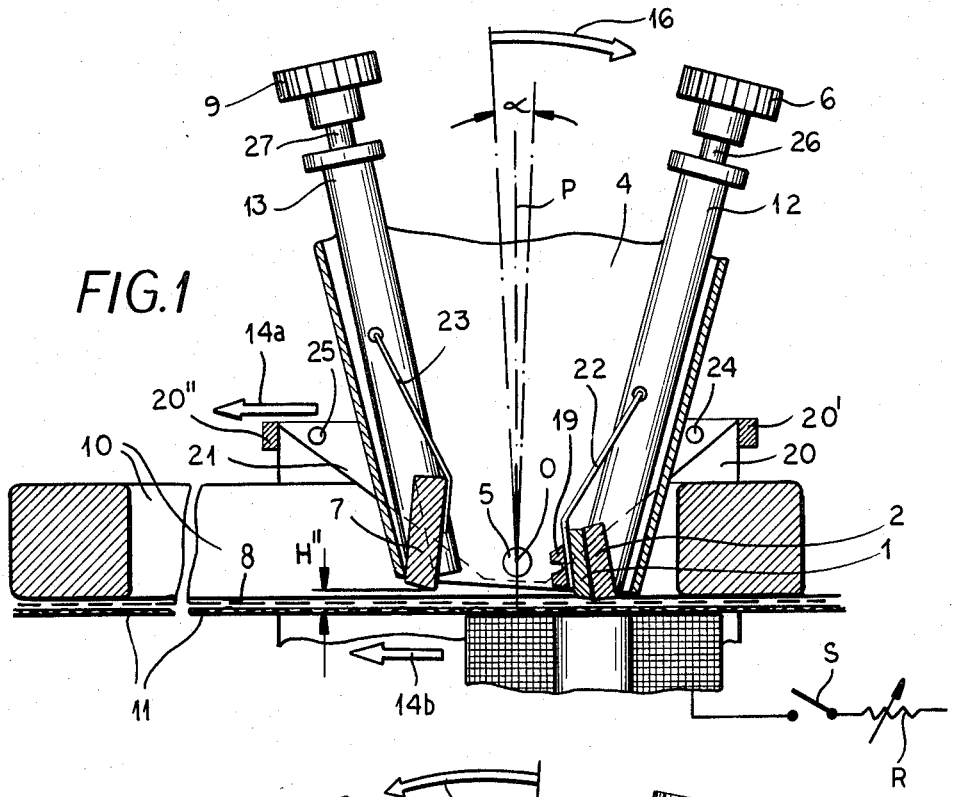
FIG. 1 is a longitudinal sectional view of the principal parts of a screen printer embodying my invention, with a wiper assembly shown in an operating position during a printing stroke.
Figure 2:
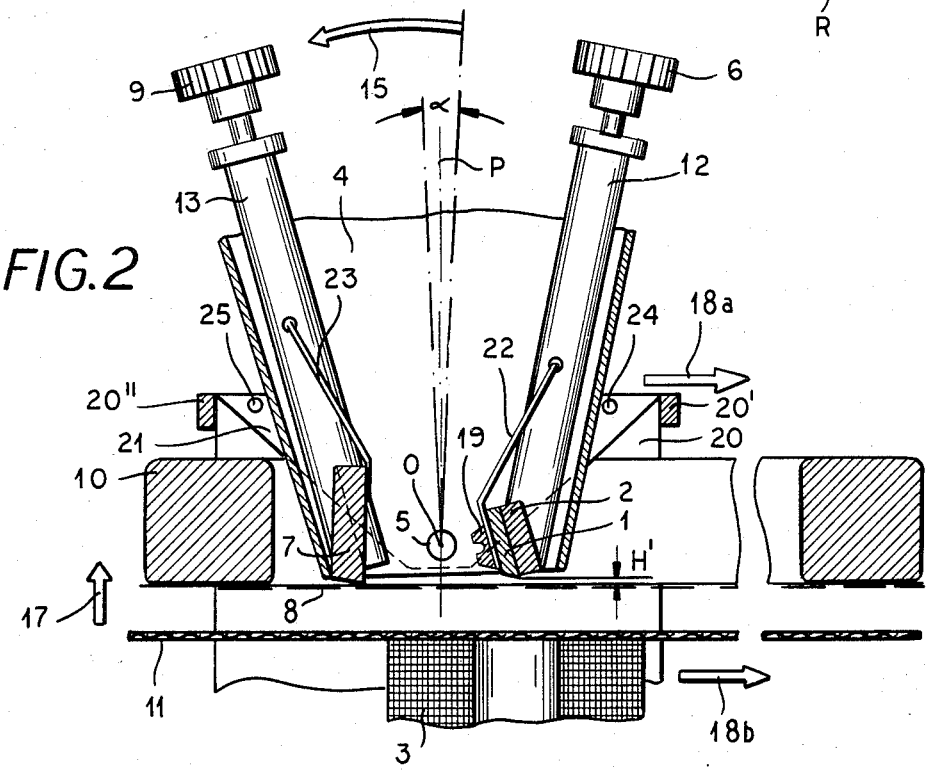
FIG. 2 is a view similar to FIG. 1 but shows the wiper assembly in an alternate position during a return stroke.
Figure 3:
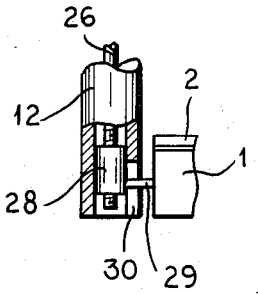
FIG. 3 is a detail view, partly in section, showing a working wiper adjustably supported on a holder therefor.

In FIGS. 1–3 I have shown a screen printer comprising a horizontal frame 10 overlying a substrate 11, e.g. a sheet of fabric, to be imprinted. The frame 10 is vertically movable between a lower level close to the substrate, FIG. 1, and a somewhat elevated level spaced from that substrate, FIG. 2, as indicated by an arrow 17 in the latter Figure. In the horizontal direction, however, the frame 10 is considered stationary whereas a carriage 20 is reciprocable relatively thereto as indicated by arrows 14*a* and 18*a* in FIGS. 1 and 2; the carriage is lifted and lowered jointly with the frame upon reaching one or the other terminal position of its motion. Frame 10 is spanned by a screen 8 acting as a printing mask as is well known in the art.

Carriage 20, of which only one end is visible along with connecting bars 20', 20'' linking it with an opposite end, straddles the frame 10 and is provided at each end with an infolded bracket 21 reaching around an adjoining longitudinal edge of the frame. A cradle 4, also visible only in part, is pivoted at each end by a respective stub shaft 5 to the adjoining bracket 21 to swing about a horizontal axis O defined by these shafts. Studs 24 and 25 on each bracket 21 limit the swing of the cradle to two terminal positions almost but not quite attained in FIGS. 1 and 2, respectively. The maximum swing angle $\alpha$ is bisected by a vertical plane of symmetry P passing through axis O.

Each end of cradle 4 carries two relatively inclined, downwardly converging guide tubes serving as holders for respective wipers 1 and 7 which lie on opposite sides of pivotal axis O. The two guide tubes 12 and 13 seen in the drawing are provided with respective knobs 6 and 9 having stems 26, 27 which, as particularly illustrated for tube 12 and stem 26 in FIG. 3, are threaded into respective cylindrical sleeves near the lower end of each tube. The internally threaded sleeve 28 shown in FIG. 3 is rigidly connected with an end of wiper 1 by a pin 29 projecting laterally through a slot 30 of tube 12. The opposite end of wiper 1 is similarly connected with cylindrical slides in the counterpart of tube 12 which, however, need not be provided with a knob and a threaded stem so that the raising or lowering of wiper 1 can be controlled exclusively by the knob 6. Wiper 7 is connected in an entirely analogous manner with the threaded sleeve in tube 13 and a similar slider in its counterpart at the opposite end of cradle 4 for raising and lowering by means of knob 9.

As shown in FIGS. 1–3, working wiper 1 is a doctor blade connected by screws 19 (only one shown) with a larger backing plate 2 of soft iron; blade 1 preferably consists itself of magnetizable material. Distributing wiper 7, on the other hand, is a more massive blade of nonpermeable or diamagnetic material—e.g. lead or copper—whose weight substantially exceeds that of the combination of wiper 1 and backing plate 2. The position of the two blades on their holders 12 and 13 is further stabilized by leaf springs 22 and 23 which are anchored to these holders without impeding the limited vertical adjustment of these wipers by knobs 6 and 9; such leaf springs can also be provided on the other pair of holders near the nonillustrated proximal end of cradle 4.

Underneath substrate 11, and directly in line with blade 1, lies an electromagnet 3 mounted on a nonillustrated support on which it moves codirectionally and conjointly with carriage 20, as indicated by arrows **14*b* and 18*b* in FIGS. 1 and 2. In contrast to carriage 20, however, electromagnet 3** is not vertically displaced but always stays close to the lower substrate surface.

An energizing circuit for electromagnet 3 includes a switch S and an adjustable resistor R connected to a source of operating current not shown. Closure of switch S attracts the plate 2 and the blade 1 into the position of FIG. 1, as indicated by an arrow 16, in which the acute-angled lower edge of the blade rests on the screen 8 while the distributing blade 7 is lifted off that screen by a distance H''. With carriage 20 and electromagnet 3 now advancing toward the left-hand end of frame 10 as indicated by arrows **14*a* and 14*b*, doctor blade 1 presses dyestuff previously deposited on that screen through its perforations onto the substrate 11. During this printing stroke the working wiper 1 trails the elevated distributing wiper 7** which exerts a certain leveling effect on the nonillustrated layer of dyestuff.

After completion of the printing stroke, electromagnet 3 is de-energized by an opening of switch S whereupon the overriding weight of wiper 7 tilts the cradle 4—as indicated by an arrow 15—into the alternate position of FIG. 2 in which that wiper comes to rest on the screen 8 while blade 1 is lifted off the screen by a distance H'. Carriage 20 and electromagnet 3 now return to the position of FIG. 1, as indicated by arrows **18*a* and 18*b*, but with the carriage and the frame 10 at the aforementioned higher level so as to keep the screen 8 clear of substrate 11**.

In the operating position of FIG. 1, the attractive force of electromagnet 3 upon wiper 1 and its backing plate 2 can be adjusted with the aid of resistor R. That adjustment, however, has no effect upon the pressure exerted by wiper 7 on the screen in the position of FIG. 2. It will be noted that spacings H' and H'' are jointly determined by the positions of wipers 1 and 7 as illustrated. A significant upward retraction of these wipers, however, will let the abutments 24 and 25 come into play.

Figure 4:
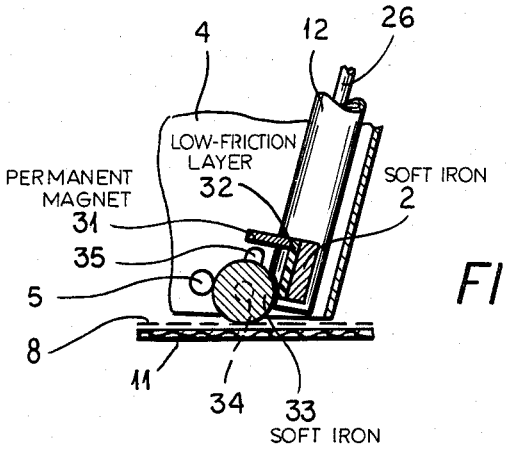
FIG. 4 is a fragmentary view of a modified wiper assembly in an operating position corresponding to that of FIG. 1.
Figure 5:
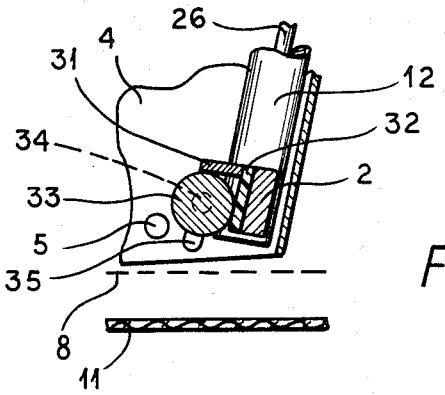
FIG. 5 is a view similar to FIG. 4, showing the assembly in an alternate position corresponding to that of FIG. 2.

In FIGS. 4 and 5 I have shown a modification of the right-hand part of cradle 4 in which the working wiper is a soft-iron roller 33 with gudgeons 34 guided parallel to tube 12 in respective slots 35 on opposite ends of the cradle. There is no direct connection between this tube and the roller which is separated by a low-friction layer 32, preferably of plastic material, from a backing plate 2 of soft iron whose elevation is controlled as before by the stem 26 shown in FIGS. 1 and 2. A permanent bar magnet 31, secured to plate 2 by way of layer 32, spacedly overhangs the roller 33 in the operating position of FIG. 4 in which that roller is attracted by the stronger electromagnet 3 (FIG. 1) in its energized state. Plate 2 is also attracted downward to tilt the cradle 4 into its limiting position defined by the abutment 24 of FIGS. 1 and 2. On the return stroke, with the electromagnet de-energized, gravity again swings the cradle 4 into its alternate position—defined by abutment 25—while roller 33 is attracted upward by permanent magnet 31. The distributing wiper, not shown in FIGS. 4 and 5, corresponds to that of FIGS. 1 and 2.

Gudgeons 34 and slots 35 could be omitted in some instances, namely when the force of magnet 31 suffices to entrain the roller on the return stroke.

It will be understood that the single electromagnet 3 shown in the drawing is representative of a row of such electromagnets extending parallel to wiper 1 or 33 across the underside of the substrate.

I claim:

1. An apparatus for printing a pattern on a horizontal substrate, comprising:

a horizontal frame above the substrate to be printed;

a flat screen with a pattern of dyestuff-permeable perforations spanning said frame;

a carriage movable relatively to said frame along a horizontal path at a lower level, relative to said screen during a printing phase, in one direction and at a higher level, during a non-printing phase, in the opposite direction;

support means on said carriage swingable between an operating printing position and an alternate scraping position about a horizontal pivotal axis transverse to said path;

an at least partly magnetizable first mass carried by said support means on one side of said pivotal axis, said first mass including a working wiper extending across said frame above said screen;

a nonmagnetizable second mass heavier than said first mass carried by said support means on an opposite side of said pivotal axis, said second mass including a distributing wiper extending across said frame above said screen;

electromagnetic means disposed directly below said first mass below said screen and a substrate overlain thereby, said electromagnetic means being movable concurrently and codirectionally with said carriage relatively to said frame; and switch means for energizing said electromagnetic means during motion in said one direction, with resulting attraction of said working wiper onto said screen for pressing dyestuff accumulated thereon through said perforations onto the underlying substrate in the operating position of said support means, and de-energizing said electromagnetic means during motion in said opposite direction for enabling a swinging of said support means, acting on said nonmagnetizable second mass, by gravity into said alternate position in which said distributing wiper spreads residual dyestuff over the screen surface, said frame being vertically movable jointly with said carriage between a lower level and a higher level for keeping said screen spaced from the substrate during motion in said opposite direction.

2. An apparatus as defined in claim 1 wherein, with said frame stationary, said working wiper trails said distributing wiper during carriage motion in said one direction.

3. An apparatus as defined in claim 1 wherein said support means comprises a cradle with adjustable holders for changing the separation of either wiper from said screen in an elevated position thereof.

4. An apparatus as defined in claim 1 wherein said working wiper comprises a magnetically permeable doctor blade secured to a magnetically permeable backing plate.

5. An apparatus as defined in claim 1 wherein said first mass includes a magnetically permeable, generally upright backing plate, said working wiper being a magnetically permeable roller separated from said backing plate by a low-friction layer.

6. An apparatus as defined in claim 5 wherein said first mass further includes a permanent magnet overlying said roller for attracting same onto itself and away from said screen in said alternate position of said support means, said permanent magnet being weaker than said electromagnetic means in the energized state thereof whereby said roller is attracted onto said screen and away from said permanent magnet in said operating position.

7. An apparatus as defined in claim 6 wherein said roller engages a guiding formation of said support means keeping said roller close to said low-friction layer.

8. An apparatus as defined in claim 1, further comprising current-control means in series with said switch means for varying the attractive force of said electromagnet.

* * * * *